US008826875B2

(12) United States Patent
Itoafa

(10) Patent No.: US 8,826,875 B2
(45) Date of Patent: Sep. 9, 2014

(54) ACTUATOR OF AN ELECTROHYDRAULIC GAS EXCHANGE VALVE DRIVE OF AN INTERNAL COMBUSTION ENGINE

(75) Inventor: Calin Petru Itoafa, Hochstadt (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/825,590

(22) PCT Filed: Jul. 28, 2011

(86) PCT No.: PCT/EP2011/062982
§ 371 (c)(1),
(2), (4) Date: Mar. 22, 2013

(87) PCT Pub. No.: WO2012/048924
PCT Pub. Date: Apr. 19, 2012

(65) Prior Publication Data

US 2013/0174799 A1 Jul. 11, 2013

(30) Foreign Application Priority Data

Oct. 11, 2010 (DE) ..... 10 2010 048 135

(51) Int. Cl.
*F01L 1/14* (2006.01)
*F01L 1/24* (2006.01)

(52) U.S. Cl.
CPC .... *F01L 1/14* (2013.01); *F01L 1/24* (2013.01)
USPC ..... 123/90.52; 123/90.48

(58) Field of Classification Search
CPC ..... F01L 1/14; F01L 2105/00; F01L 1/245; F01L 2107/00; F01L 13/0031
USPC ..... 123/90.52, 90.43, 90.48, 90.59
See application file for complete search history.

(56) References Cited

U.S. PATENT DOCUMENTS

| | | | | |
|---|---|---|---|---|
| 6,039,017 | A * | 3/2000 | Hendriksma | 123/90.43 |
| 2008/0047510 | A1 | 2/2008 | Hong | |

FOREIGN PATENT DOCUMENTS

| | | |
|---|---|---|
| DE | 3529446 | 2/1987 |
| DE | 19712656 | 10/1998 |
| DE | 102004036108 | 2/2006 |
| DE | 102007014248 | 9/2008 |
| DE | 102007030215 | 1/2009 |
| DE | 2009016506 | 2/2009 |
| DE | 102007051302 | 4/2009 |
| DE | 102008013259 | 9/2009 |
| EP | 2065571 | 6/2009 |
| FR | 2924747 | 6/2009 |

* cited by examiner

*Primary Examiner* — Zelalem Eshete
(74) *Attorney, Agent, or Firm* — Volpe and Koenig, P.C.

(57) ABSTRACT

The invention relates to an actuator of an electrohydraulic gas exchange valve drive of an internal combustion engine, comprising an actuator housing (4), which can be fixed in the internal combustion engine and which comprises a bore (9); a valve play compensation element (8) which is received in said bore in an axially movable manner and which comprises a compensating housing (12) for actuating the gas exchange valve (1); and an axial stop which limits the extending movement of the compensation housing out of the bore (9) and which comprises stopes (14, 15) that overlap each other radially. The stop (14) on the compensation housing-side is a collar of a sleeve (18) that surrounds the outer casing of the compensation housing said collar extending outwards in a radial manner.

8 Claims, 3 Drawing Sheets

ACTUATOR OF AN ELECTROHYDRAULIC GAS EXCHANGE VALVE DRIVE OF AN INTERNAL COMBUSTION ENGINE

BACKGROUND

The invention concerns an actuator of an electrohydraulic gas exchange valve train of an internal combustion engine, said actuator comprising an actuator housing which can be fixed in the internal combustion engine, said actuator housing comprising a bore, a valve lash adjuster being received axially displaceable in said bore, said lash adjuster comprising a compensating housing for operating the gas exchange valve and further comprising an axial stop for limiting an outward travel of the compensating housing out of said bore and said axial stop comprising radially overlapping stops which are fixed in axial direction on said bore and on said compensating housing.

It is known that the variability of the opening and closing times of gas exchange valves and of the maximum valve lift is achieved in electrohydraulic valve trains in that a so-called hydraulic linkage together with a pressure chamber is arranged between a cam of a camshaft and the gas exchange valve, wherein the volume of the pressure chamber can be continuously reduced through an electromagnetic hydraulic valve into a pressure relief chamber. Depending on the reduction volume of the hydraulic medium, the cam lift produced by the camshaft is converted fully, partially or not at all into a lift of the gas exchange valve.

The present invention relates to that part of the valve train actuating system that is situated on the gas exchange valve side and whose movement corresponds to the lift of the gas exchange valve. An actuator of the pre-cited type is known, for example, from DE 10 2007 030 215 A1. The actuator housing in this case is a bushing that is screwed into a hydraulic unit that is fixed in the cylinder head of the internal combustion engine and in whose bore a hydraulically loaded slave cylinder and, adjoining this, a hydraulic valve lash adjuster of a known type are mounted for axial movement. In the disassembled state of the actuator or of the hydraulic unit, the compensating housing of the valve lash adjuster is not seated on the gas exchange valve, and the compensating housing is prevented from falling out of the bore of the actuator housing through the axial stop that is then active. The stops of the axial stop on the compensating housing are made in the form of a polygonal snap ring that is inserted into an annular groove on the outer peripheral wall of the compensating housing to protrude in radial direction therefrom, and the stops on the bore are constituted by a shoulder that is formed by a bore opening with a reduced diameter.

SUMMARY

The object of the present invention is to improve the structure of an actuator of the pre-cited type such that, with differently configured gas exchange valve trains that, in particular, create differently large maximum lifts on the gas exchange valve, appropriately adapted actuators comprising the largest possible number of identical parts (low-cost manufacture) can be used.

The above object is achieved by implementing one or more of the features of the invention, whereas advantageous developments and configurations of the invention are the subject matter of the dependent claims. According to the invention, the stop on the compensating housing is a radially outwards extending collar of a bushing that surrounds the outer peripheral wall of the compensating housing. In contrast to the cited prior art, in which the stop on compensating housing is made in the form of a snap ring which is always situated at the same axial position relative to the compensating housing, the bushing of the invention serves as a simple to adapt bushing collar with a variable-positioning upper vertical stop in the form of the bushing collar. As a result, the axial movability of the compensating housing within the bore can be varied through the axial dimensioning of the bushing and can be adapted to differently configured gas exchange valve trains, while the compensating housings and, given the case, also the actuator housings always remain identical.

According to a further development of the invention, the stop surface on the collar extends in a gas exchange valve distal direction outside of the axial dimension of the outer peripheral wall of the compensating housing. Through this configuration, it becomes possible to always use large series compensating housings with a uniform standard length even if the maximum lift to be transmitted by the actuator to the gas exchange valve is relatively high.

The axial fixing of the bushing on the compensating housing can be realized on the one hand through positive engagement. For this purpose, the inner peripheral wall of the bushing, for instance, can comprise at least one bead that engages into an annular groove on the outer peripheral wall of the compensating housing. Alternatively, the bushing may engage behind the outer peripheral wall of the compensating housing on a radially tapering end section of the compensating housing near the gas exchange valve.

On the other hand, the axial fixing of the bushing on the compensating housing can also be realized through force locking which creates an interference fit between the inner peripheral wall of the bushing and the outer peripheral wall of the compensating housing. The interference fit enables the bushing to be fixed on the compensating housing at largely variable axial positions of the stop.

Further, the stop on the bore is a radially inwards extending collar of a further bushing that surrounds an outer peripheral wall of the actuator housing. In contrast to the cited prior art, it is not necessary to make the bore with a stepped configuration which necessitates a relatively complex undercut. In an alternative to this embodiment, the further bushing does not surround the outer peripheral wall of the actuator housing but is fixed on the inner peripheral wall of the bore.

The axial fixing of the further bushing can be realized through force locking which creates an interference fit between the inner peripheral wall of the bushing and the outer peripheral wall of the actuator housing (or, according to the aforesaid alternative comprising a further bushing that lines the bore between the outer peripheral wall of the further bushing and the inner peripheral wall of the bore). The interference fit further enables the further bushing to be fixed on the actuator housing at largely variable axial positions of the stop on the bore.

The stop on the bore may also be in the form of a ring, for instance an elastomer O-ring or likewise a snap ring that is inserted into an annular groove extending in the bore and protruding radially out of the annular groove.

The bushings of the invention can be made particularly as thin-walled, drawn parts out of a sheet metal material or as injection molded parts out of a plastic material.

BRIEF DESCRIPTION OF THE DRAWINGS

Further features result from the following description and the appended drawings in which parts or details of examples of embodiment of an actuator are illustrated that are important for a better understanding of the invention. If not otherwise mentioned, identical or functionally identical features or components bear identical reference numerals. The figures show.

DETAILED DESCRIPTION OF THE PREFERRED EMBODIMENTS

Figure 7A:
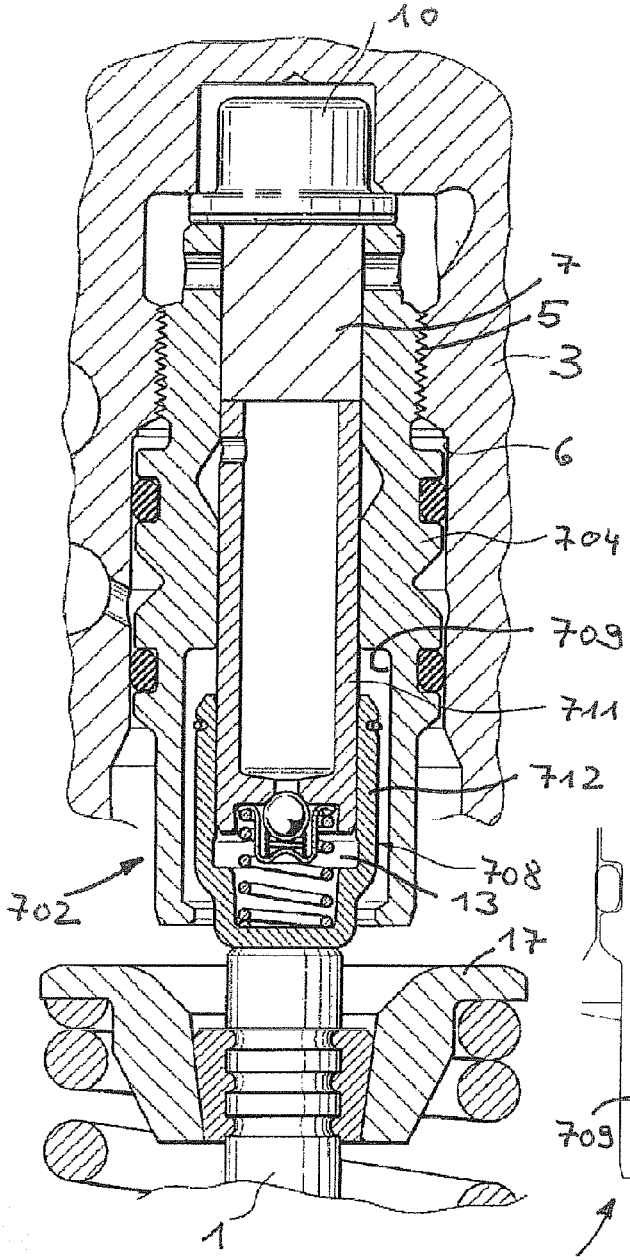
FIG. 7*a*, a prior art actuator, in the operable assembled state.

For the sake of a better understanding, the invention may be described with reference to FIG. 7*a* which discloses a section of a prior art electrohydraulic gas exchange valve train for a variable operation of a gas exchange valve 1 that is spring-loaded in closing direction. The section shows an actuator 702 that is fixed in a hydraulic unit 3 that in its turn is arranged in a cylinder head (not shown) of an internal combustion engine between a camshaft and the gas exchange valves and serves for a variable-lift transmission of a cam lift to the respective gas exchange valve 1.

The actuator 702 comprises a hollow cylindrical actuator housing 704 that is fixed through a screw connection 5 in a reception 6 of the hydraulic unit 3, and further comprises a slave piston 7 and a hydraulic valve lash adjuster 708, both of which are received axially movable in the central bore 709 under a choking valve 10 which serves as a hydraulic brake. The slave piston 7 which is loaded through hydraulic pressure in its turn actuates a pressure piston 711 of a known type that, through a compensating housing 712 which contacts the gas exchange valve 1, forms a variable-height pressure chamber 13 of the valve lash adjuster 708.

Figure 7B:
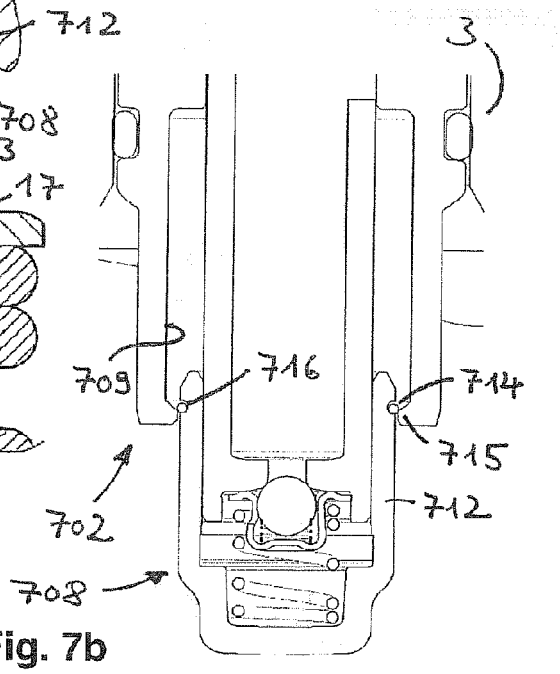
FIG. 7*b*, the actuator of FIG. 7*a* in the disassembled state

In the operational state illustrated, the gas exchange valve 1 is closed and the slave piston 7 and the valve lash adjuster 708 are accordingly fully retracted into the actuator housing 704. In contrast, FIG. 7*b* shows the actuator 702 in the disassembled state of the hydraulic unit 3 in which the valve lash adjuster 708 is extended out of the bore 709 up to the limitation formed by an axial stop. The stops 714 and 715 constituting the axial stop are a snap ring disposed on the compensating housing 712 and a shoulder of the bore 709 arranged on the opening of the bore 709 that is made with an undercut. The snap ring 714 is inserted into an annular groove 716 which extends in the outer peripheral wall of the compensating housing 712, and, due its polygonal shape, the snap ring 714 protrudes at points so far out of the annular groove 716 as to overlap the shoulder 715 in radial direction, and thus prevents the compensating housing 712 from falling out of the bore 709 in the shown stop position. In this stop position, the compensating housing 712 is extended slightly further outwards than during an operational maximum lift on the gas exchange valve 1. Thus, if the compensating housing 712 remains unchanged but the maximum lift increases, it would be necessary to shift the shoulder which constitutes the stop 715 on the bore in direction of the spring collar 17. However, this modification is subject to narrow limits because a minimum free axial motion of the actuator housing 704 relative to the spring collar 17 must be preserved. In addition, such a modification would not be compatible with the principle of using identical parts.

Examples of embodiment of the inventive actuators of electrohydraulic gas exchange valve trains which, in particular, enable the use of identical valve lash adjusters 8 with different maximum lifts of the gas exchange valves are described in the following with reference to the appended FIGS. 1 to 6. All embodiments comprise a bushing 18 that is made out of sheet metal material by deep drawing and surrounds the outer peripheral wall of the compensating housing 12, wherein the stop 14 on the compensating housing is constituted by a radially outwards extending collar of the bushing 18.

Figure 1A:
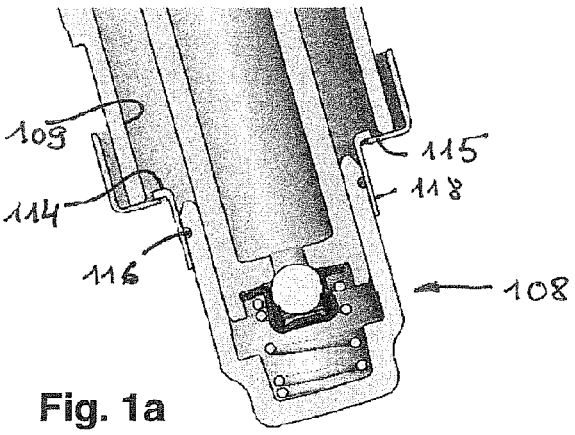
FIG. 1*a*, a first example of embodiment of the invention, in a longitudinal section.
Figure 1B:
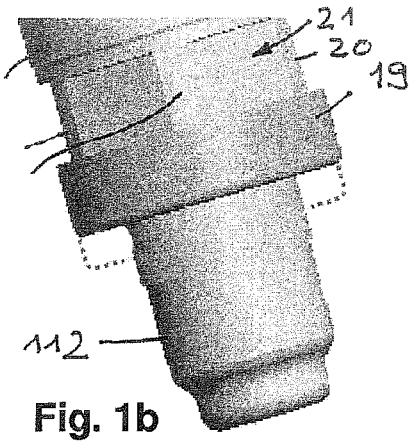
FIG. 1*b*, the first example of embodiment of the invention in a non-sectional representation.

FIGS. 1*a* and 1*b* show a first example of embodiment. The compensating housing 112 is taken from a construction kit for conventional standard valve trains with hydraulic valve lash adjustment and it accordingly comprises an annular groove 116 for a snap ring. In this case, however, the annular groove 116 has no function because the bushing 118 is fixed on the compensating housing 112 between the inner peripheral wall of the bushing 118 and the outer peripheral wall of the compensating housing 112 through force locking, i.e. through a longitudinal interference fit. To enable the manufacturing of the bore 109 without undercuts and at comparatively low costs, the stop 115 on the bore 109 is formed by a collar of a further deep drawn bushing 19 that surrounds the outer peripheral wall of the actuator housing 104. The axial fixing of the further bushing 19, too, is achieved through force locking in that, between the inner peripheral wall of the bushing 19 and the six circular arc-shaped surfaces 20 of the hexagon 21 that serves to screw in the actuator housing 104, is formed an interference fit in which the radially inwards extending collar 115 bears against the gas exchange valve side front end surface of the actuator housing 104. As an alternative to this, the dotted-line contour shown in FIG. 1*b* is meant to indicate that the further bushing 19 can be pressed onto the front end surface of the actuator 104 up to a certain pre-determined axial position even without a stop in order to vary the position of the axial stop as required.

Figure 2A:
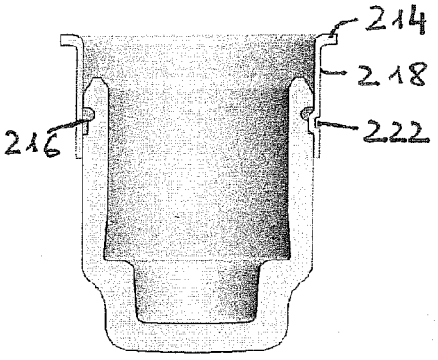
FIG. 2*a*, the compensating housing including a bushing of a second example of embodiment of the invention, in a longitudinal section.
Figure 2B:
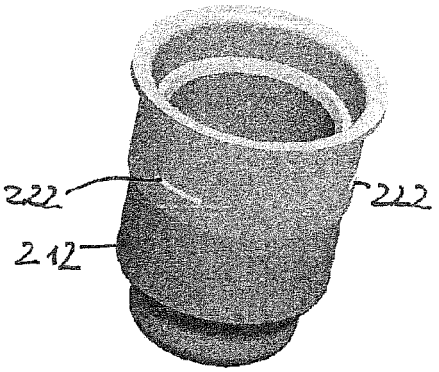
FIG. 2*b*, the compensating housing including the bushing of FIG. 2*a*, in a perspective representation.

FIGS. 2*a* and 2*b* show a second example of embodiment. The axial fixing of the bushing 218 on the compensating housing 212 is realized in this case by positive engagement in that the inner peripheral wall of the bushing 218 comprises three beads 222 that are uniformly distributed in peripheral direction, and said beads engage into an annular groove 216 that is modified with respect to FIG. 1.

Figure 3:
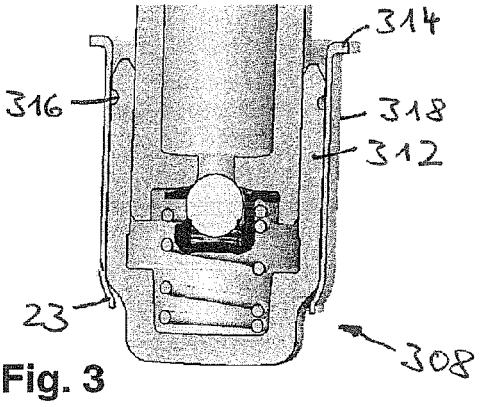
FIG. 3, the valve lash adjuster of a third example of embodiment of the invention, in a longitudinal section.

In the third example of embodiment shown in FIG. 3, the axial fixing of the bushing 318 on the compensating housing 312 is realized both through force locking and through positive engagement. The positive engagement is realized in that a diameter constriction 23 of the bushing 318 engages behind the radially tapering gas exchange valve proximate end section of the outer peripheral wall of the compensating housing 312. Accordingly, in this case too, the annular groove 316 of the compensating housing 312 taken from the construction kit for conventional standard valve trains has no function. Force locking is realized through a comparatively light longitudinal interference fit between the inner peripheral wall of the bushing 318 and the outer peripheral wall of the compensating housing 312.

Figure 4A:
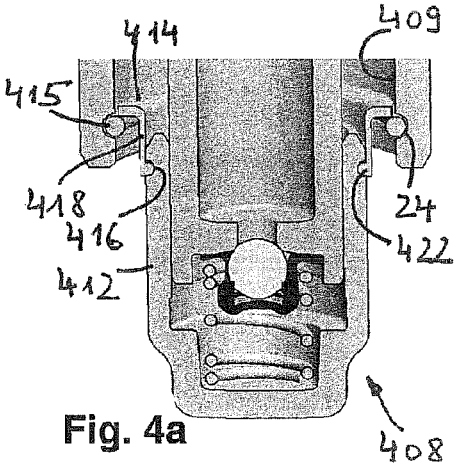
FIG. 4*a*, a fourth example of embodiment of the invention, in a longitudinal section.

The stop 415 on the bore 409 in the fourth example of embodiment shown in FIG. 4*a* is constituted by a snap ring that is inserted into an annular groove 24 that is worked into the bore 409, and said snap ring protrudes radially out of the annular groove 24. The axial fixing of the bushing 418 on the compensating housing 412 is realized through positive engagement of a circumferential bead 422 of the bushing 418 engaging into the annular groove 416, said bushing 418 being optionally slit in axial direction for facilitating its mounting on the compensating housing 412.

Figure 4B:
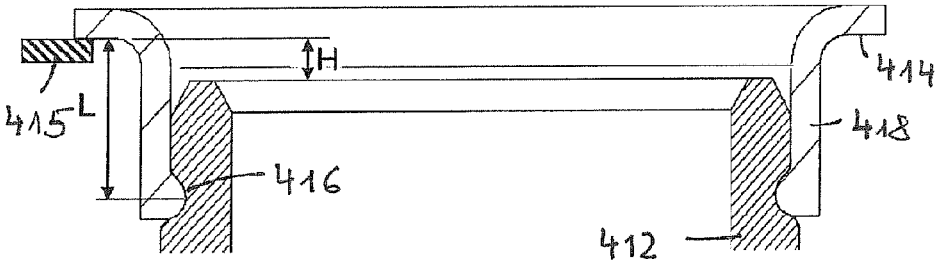
FIG. 4*b*, the compensating housing including the bushing of FIG. 4*a*, as a detail.
Figure 5:
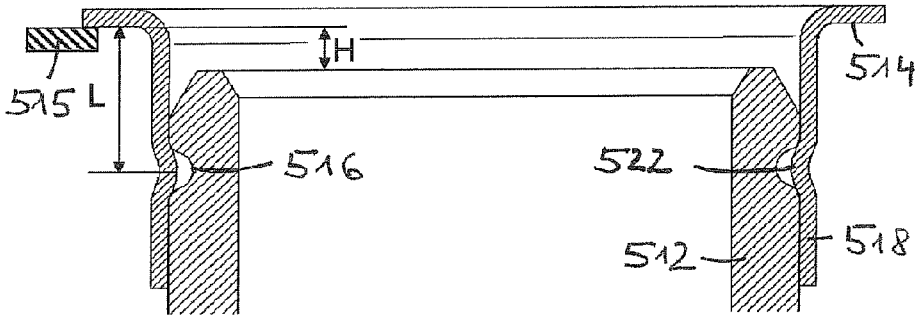
FIG. 5, the compensating housing including a bushing of a fifth example of embodiment of the invention, as a detail.
Figure 6:
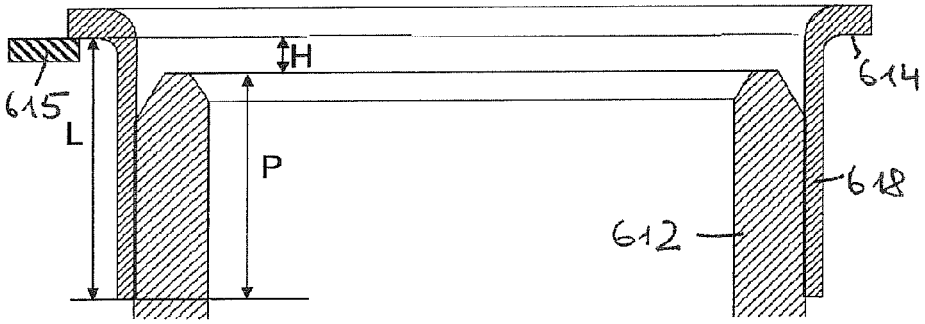
FIG. 6, the compensating housing including a bushing of a sixth example of embodiment of the invention, as a detail.

FIG. 4*b* is a detail view of the example of embodiment shown in FIG. 4*a*, and FIGS. 5 and 6 disclose, as mentioned above, further structural design alternatives for the bushing 18 which serves as a stop adapter. As shown in FIG. 7*b*, the symbolically illustrated stop 15 on the bore determines the extended position of the compensating housing 12 that is limited by the respective axial stop.

The fifth example of embodiment shown in FIG. 5 corresponds to the first example of embodiment in FIG. 1*a*, wherein, in place of the interference fit on the inner peripheral wall of the bushing 518, a bead 522 in positive engagement with the annular groove 516 is used.

The sixth example of embodiment shown in FIG. 6 likewise corresponds to the first example of embodiment, wherein, however, the compensating housing 612 does not comprise an annular groove. In these examples of embodiment, too, the stop surface 614 of the collar always extends in a gas exchange valve distal direction outside of the axial dimension of the outer peripheral wall of the compensating housing 612. Or, to put it more simply, the stop 614 extends spaced by an axial dimension H from the gas exchange valve distal front end surface of the compensating housing 612. This means that, in the case of both the compensating housings 412 and 512 comprising annular grooves 416 and 516 respectively, the maximum lift on the gas exchange valve with an unmodified compensating housing 12 can be enlarged by the dimension L relative to the example of prior art shown in FIG. 10. In the case of the compensating housing 612 without an annular groove, the maximum lift on the gas exchange valve depends on the bushing dimension L and on the pressing dimension P of the bushing 618 on the compensating housing 612.

LIST OF REFERENCE NUMERALS

1 Gas exchange valve
2 Actuator
3 Hydraulic unit
4 Actuator housing
5 Screw connection
6 Reception
7 Slave piston
8 Valve lash adjuster
9 Bore of the actuator housing
10 Choking valve
11 Pressure piston
12 Compensating housing
13 Pressure chamber
14 Stop on the compensating housing
15 Stop on the bore
16 Annular groove
17 Spring collar
18 Bushing
19 Further bushing
20 Circular arc-shaped surface
21 Hexagon
22 Bead
23 Diameter constriction
24 Annular groove

The invention claimed is:

1. An actuator of an electrohydraulic gas exchange valve train of an internal combustion engine, said actuator comprising an actuator housing which is fixable in the internal combustion engine, said actuator housing comprising a bore, a valve lash adjuster being received axially displaceable in said bore, said valve lash adjuster comprising a compensating housing for operating the gas exchange valve and an axial stop for limiting an outward travel of the compensating housing out of said bore and said axial stop comprising radially overlapping stops which are fixed in axial direction on said bore and on said compensating housing, the stop on the compensating housing is a radially outwardly extending collar of a bushing that surrounds an outer peripheral wall of the compensating housing.

2. An actuator according to claim 1, wherein the collar has a stop surface that extends in a gas exchange valve distal direction outside of an axial dimension of the outer peripheral wall of the compensating housing.

3. An actuator according to claim 1, wherein axial fixing of the bushing is realized through positive engagement via at least one bead on an inner peripheral wall of the bushing that engages into an annular groove on the outer peripheral wall of the compensating housing.

4. An actuator according to claim 1, wherein axial fixing of the bushing is realized through positive engagement of the bushing behind the outer peripheral wall of the compensating housing on a radially tapering end section of the compensating housing near the gas exchange valve.

5. An actuator according to claim 1, wherein axial fixing of the bushing is realized through force locking by an interference fit between an inner peripheral wall of the bushing and the outer peripheral wall of the compensating housing.

6. An actuator according to claim 1, wherein the stop on the bore is a radially inwardly extending collar of a further bushing that surrounds an outer peripheral wall of the actuator housing.

7. An actuator according to claim 6, wherein axial fixing of the further bushing is realized through force locking by an interference fit between an inner peripheral wall of the further bushing and the outer peripheral wall of the actuator housing.

8. An actuator according to claim 1, wherein the stop on the bore is a ring that is inserted into an annular groove that extends in the bore.

* * * * *